US007859430B2

(12) United States Patent
Ochiai

(10) Patent No.: US 7,859,430 B2
(45) Date of Patent: Dec. 28, 2010

(54) LED ROAD TRAFFIC SIGNAL LIGHT

(75) Inventor: Taro Ochiai, Fukuoka (JP)

(73) Assignee: Nakamura Sangyo Gakuen, Fukuoka (JP)

( * ) Notice: Subject to any disclaimer, the term of this patent is extended or adjusted under 35 U.S.C. 154(b) by 243 days.

(21) Appl. No.: 12/086,407

(22) PCT Filed: Dec. 14, 2005

(86) PCT No.: PCT/JP2005/022921

§ 371 (c)(1),
(2), (4) Date: Aug. 4, 2008

(87) PCT Pub. No.: WO2007/069306

PCT Pub. Date: Jun. 21, 2007

(65) Prior Publication Data

US 2009/0284393 A1 Nov. 19, 2009

(51) Int. Cl.
*G08G 1/095* (2006.01)

(52) U.S. Cl. ..... 340/907

(58) Field of Classification Search ..... 340/907, 340/815.45, 815.56, 815.43; 362/227
See application file for complete search history.

(56) References Cited

U.S. PATENT DOCUMENTS 6,051,932 A * 4/2000 Sheu et al. ..... 315/169.3
7,145,571 B2 * 12/2006 Jones et al. ..... 345/589
2003/0137432 A1 * 7/2003 Wiseman ..... 340/907
2003/0156044 A1 * 8/2003 Wiseman ..... 340/907
2005/0190075 A1 * 9/2005 Wiseman ..... 340/907

FOREIGN PATENT DOCUMENTS

| | | |
|---|---|---|
| JP | 8-138192 | 5/1996 |
| JP | 10-3596 | 1/1998 |
| JP | 11-61751 | 3/1999 |
| JP | 11-110692 | 4/1999 |
| JP | 2001-14591 | 1/2001 |
| JP | 2002-231003 | 8/2002 |
| JP | 2004-217723 | 8/2004 |
| JP | 2006-18625 | 1/2006 |

* cited by examiner

*Primary Examiner*—Phung Nguyen
(74) *Attorney, Agent, or Firm*—Jordan and Hamburg LLP

(57) ABSTRACT

An LED road traffic signal light equipped with symbol patterning by chromaticity where a color-blind person can distinguish between red and yellow LED signal lights even at a predetermined distance without causing entire mixture discoloring. A red LED signal light comprising a group of LED elements emitting red light, wherein the group of LED elements is mixed with an identification LED element having a chromaticity different from that of the red LED element, or mixed with an identification LED element having a different luminance, or mixed with an identification LED element combining different chromaticity and luminance, thus constituting an LED road traffic signal light which can be distinguished by both physically unimpaired person and color-blind person.

2 Claims, 12 Drawing Sheets

PRIOR ART

PRIOR ART

Chromaticity diagram approved for signal lights by the Commission Internationale de l'Eclairage (CIE)

LED ROAD TRAFFIC SIGNAL LIGHT

BACKGROUND OF THE INVENTION

The present invention relates to a road traffic signal light. Specifically, the present invention relates to an LED signal light for road traffic that is distinguishable by both persons with normal vision and persons with color vision deficiency.

Presently, signal lights, using a light bulb as a light source transmitting light through colored filters of red, yellow, and green, are being replaced by LED signal lights constituted of collections of LED elements of high chromaticity and luminance of red, yellow, and green lights.

An LED signal light, arranged by assembling LED elements that emit light of the same luminance and chromaticity, has a high level of visibility in comparison to a light bulb signal light. It is rapidly spreading in use for the excellence in preventing wash-out caused by morning and afternoon sunlight, resulting from reflected lights against inside mirror.

Meanwhile, the colors of a road traffic signal light are mainly defined based on the visible ability and perception for persons with normal color vision, and adequate considerations have not necessarily been made for color deficient persons who used to distinguish kinds of signals according to brightness differences in case of light bulb type. Especially, since both the luminance and chromaticity in case of LED signal lights are constant and maximize, it has been pointed out that yellow and red appear the same to color deficient persons.

As an LED signal light that is distinguishable by color deficient persons, there is a traffic signal light with the arrangement shown in FIG. 9. With the traffic signal light 101, each of lamps 102, 103, and 104 has a holding plate, holding a plurality of light emitting diodes, and each of lamps 102, 103, and 104 performs lighting display of a different shape according to the configuration of the plurality of light emitting diodes. Specifically, the red lamp 102 displays an X shape by the plurality of light emitting diodes, the yellow lamp 103 displays a triangular shape by lighting of the plurality of light emitting diodes, and the green lamp 104 displays a circular shape by lighting of the plurality of light emitting diodes to enable color deficient persons to distinguish according to lighting shape (see Patent Document 1).

Also, a road traffic signal light shown in FIG. 10 is constituted of plural types of small light sources as 105 and 106 that differ in wavelengths to form a green signal light emitting surface 107, where 108 is a partially enlarged view of the light emitting surface 107. By providing a single green signal light as a whole, distributing of the small light sources 105 and 106, a color deficient person is made to recognize a green signal light (see Patent Document 2).

Patent Document 1: Japanese Published Unexamined Patent Application No. H10-3596 (Abstract, FIG. 1)

Patent Document 2: Japanese Published Unexamined Patent Application No. H8-138192 (Abstract, FIG. 1)

Although with the invention of Patent Document 1, the red, yellow, and green lamps of the traffic signal light are lighted in the X, triangular, and circular shapes to enable a color deficient person to distinguish which lamp is lighted, for a normal vision person, such a traffic signal light is strangely perceived from a normal signal light, and is specifically recognizable as a design for the color deficient person.

Also, the chromaticity and luminance ranges of a traffic signal light are defined by regulations, and when lamps are lighted in the X, triangular, and circular shapes, each lighting area becomes much smaller than a normal signal light area. Therefore, it becomes extremely difficult to secure the prescribed luminance level. It is thus considered that under daylight, a color deficient person may have difficulty in distinguishing which of the red, yellow, and green lamps is lighted.

The invention of Patent Document 2, in order to alleviate misrecognition of a red signal and a green signal by a protan, assembles small light sources of plural types that differ in main wavelength to provide a green signal light, in which lights of no less than two colors are mixed.

Here, among color deficient persons, there are protans and deutans, and although Patent Document 2 described that the number of protans is the highest, in correct actuality, the number incidence of deutan deficiency is the highest and is said to be approximately three times the number of protan deficiency. Also, the document is potentially misleading in that both protans and deutans misrecognize green and red signals. A green signal in Japan, a chromaticity closer to blue is applied for the color deficient person to help distinguishing green from red. Actually, they tend to have a rather high sensitivity to blue, so that erroneous perception between red and yellow is more of a problem in reality.

The signal light of Patent Document 2 is thus aimed at alleviating misrecognition of green by just protans and is not aimed at color deficient persons in general. Also, even if misrecognition is alleviated for just green, as long as the problem of distinguishing between red and yellow remains, the problem of erroneous perception by color deficient persons is not resolved.

The present invention has been made in view of the above points and an objective thereof is to provide a red or a yellow LED signal light with a symbolic pattern based on chromaticities that are distinguishable by color deficient persons even from a certain distance without causing color mixing as a whole.

SUMMARY OF THE INVENTION

To achieve the above objective, the present invention provides a red LED road traffic signal light with a set of light emitting LED elements different in chromaticity from the red LED elements.

Here, color deficient persons are classified according to the three patterns as protan, deutan, and tritan deficiency. Confusion lines for a protan defect, deutan defect, and tritan defect are shown in FIGS. 11A, 11B, and 11C.

With the color confusion lines for the protan and deutan deficiency (FIGS. 11A and 11B), red and yellow lie along the same color confusion line and are thus extremely difficult to distinguish by protan and deutan. Meanwhile, with the confusion lines for the tritan defect (FIG. 11C), because red, yellow, and green do not lie on the same line, the respective colors are distinguished. The protan defect and the deutan defect are thus the subjects of color deficiency in regard to signal lights.

Ranges of red, yellow, and green approved for signal lights in a xy coordinate system are defined as shown by the chromaticity diagram by the Commission Internationale de l clairage (CIE) in FIG. 12. In this xy coordinate system, although red and yellow lie along a confusion line, green is set in a coordinate area, within a green designation area, that is close to blue and is shifted from the confusion lines for protans and deutans. Thus, for protans and deutans, whereas a green light is distinguishable, distinction between red and yellow is difficult.

Thus, with the present invention, in order to enable distinction between red and yellow, distinguishing LED elements of a purplish color, differing in chromaticity from the red LED elements, are mixed in the red lamp and configured, for example, in an X-like pattern. As the set of illuminant colors, red appears as a dull brown color and the purple is clearly perceived as a bright blue color to a color deficient person, so that the vision difference is greater than a normal vision person due to the illuminant color hue difference.

Furthermore, the color emission of the distinguishing LED elements is a purplish color, such as purple, reddish purple, bluish purple, etc. which is a similar color with respect to red, so it is thus difficult from a distance to distinguish a purplish color from red for a normal vision person. Therefore, an LED signal light that does not give an odd impression for both color deficient and normal vision persons can be provided.

Also, in order to achieve the above objective, the present invention provides an LED road traffic signal light that is a red LED signal light, constituted of a set of red light emitting LED elements with an X-like pattern that is lower in luminance than the surrounding red LED elements.

A color deficient person, because of having difficulty distinguishing color hues, tends to be rather sensitive to lightness and saturation. A color deficient person, who has difficulty distinguishing different hues, is thus much better than normal vision persons in the ability to distinguish brightness of similar colors.

Thus, with the present invention, by configuring red distinguishing LED elements, made lower in luminance than the surrounding red LED elements, in, for example, an X-like pattern in the set of red LED elements to enable a color deficient person distinguishing of red. Since a color deficient person is more sensitive to brightness differences than a normal vision person, the distinguishing LED elements and the other LED elements are thereby perceived more clearly than a normal vision person.

Also, in order to achieve the above objective, the present invention provides an LED road traffic signal light that is a red LED signal light, constituted of a set of red light emitting LED elements with an X-like pattern that differs in chromaticity from the red LED elements and is made lower in luminance than the surrounding red LED elements.

Here, by configuring the distinguishing LED elements of a purplish color that differ in chromaticity from the surrounding red LED elements in an X-like pattern, for example, and by making the distinguishing LED elements lower in luminance, color deficient persons are able to distinguish the color of the signal light from a standard distance of 100 m required by the Commission Internationale de l clairage (CIE).

With the present invention, by configuring the distinguishing LED according to a pattern (for example, an X-mark) in a red LED signal light and making the distinguishing LED elements be of a purplish color, the emitting light can be chromatically recognizable by the color deficient persons (protan and deutan), and an LED signal light can be provided for both normal vision persons and color deficient persons without giving an odd impression to normal vision persons.

Also, by forming, in the LED element set of the red LED signal light, the distinguishing LEDs that are made low in luminance than the set of other LED elements and configured according to a pattern (for example, an X-mark) to enable clear recognition by color deficient persons, an LED signal light can be provided that can be distinguished by both normal vision persons and color deficient persons without giving an odd impression to normal vision persons.

Also, by forming, in the LED element set of the red LED signal light, the distinguishing LED emitting light of a chromaticity that can be recognized clearly by color deficient persons (protan and deutan), made low in luminance than the set of other surrounding LED elements, and is configured according to a pattern (for example, an X-mark) enables color deficient persons clear recognition for distinguishing between yellow and red LED signals even from a distance of 100 m.

DETAILED DESCRIPTION OF THE INVENTION

To further the understanding of the present invention, embodiments of the present invention shall now be described with reference to the drawings.

Embodiment 1

Figure 1:
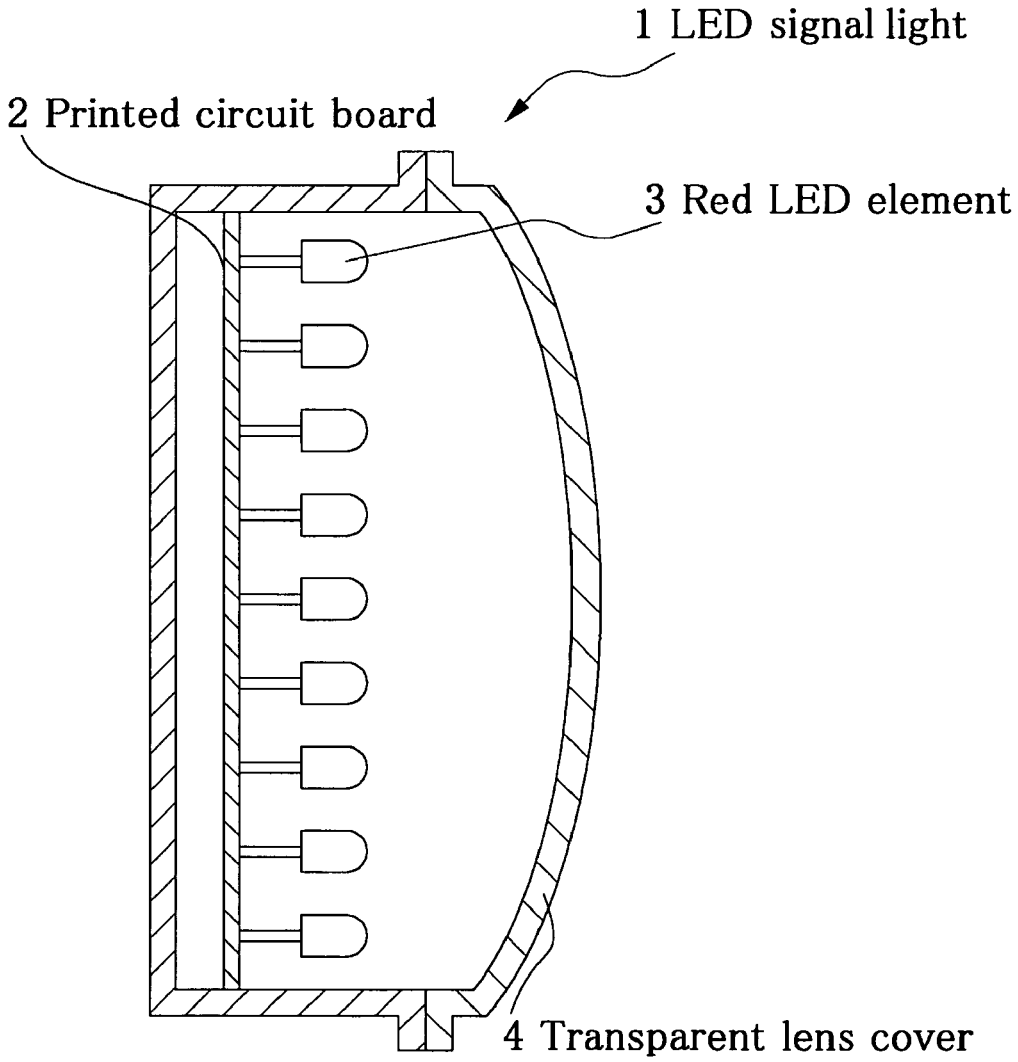
FIG. 1 is an explanatory sectional view of Embodiment 1 of an LED road traffic signal light to which the present invention is applied.
Figure 2:
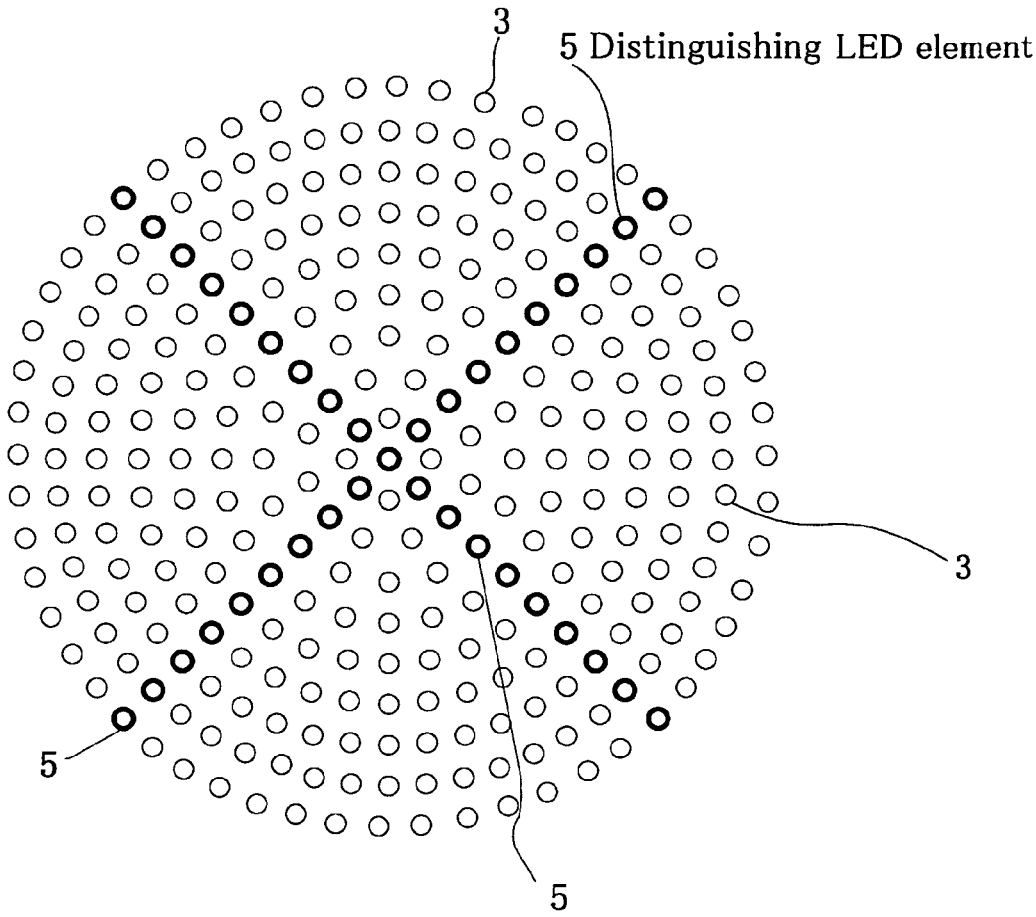
FIG. 2 is an explanatory view of an example of a configuration of distinguishing LED elements of a purplish color in a red LED signal light to which the present invention is applied.

FIG. 1 is an explanatory sectional view of an example of an LED road traffic signal light to which the present invention is applied, and FIG. 2 is an explanatory view of an example of a configuration of LED elements in the red LED signal light.

With the LED signal light 1 shown here, a plurality of red LED elements 3 is positioned in parallel on a printed circuit board 2, and a colorless, transparent or lightly colored transparent lens cover 4 is fitted in front of the LED elements.

The set of LED elements 3 is lighted, unlighted, and made to flash by an emission controller (not shown) and each LED element can be adjusted in luminance freely.

The red LED elements 3 are configured in a circular shape on the circular printed circuit board 2, and the distinguishing LED elements 5 are configured in an X-shape within the set of red LED elements 3.

The distinguishing LED elements 5 are used either full color LEDs emitting the light of reddish purple, purple, bluish purple and other purplish color of a chromaticity that can be distinguished readily by color deficient persons, or LEDs of a designated chromaticity that can be distinguished from a maximum distance at a certain range without causing color mixing.

A full color LED is an LED element, with which lights of the three primary colors of red, green, and blue are emitted within a single LED element, so that no less than 24 colors can be produced by mutually mixing these colors.

Thus, by configuring the full color LED elements, which have been controlled to emit a reddish purple, purple, or bluish purple color at the same current voltage in the X-shape within the red LED elements, the reddish purple, purple, or bluish purple color selected lights up in the X-shape within the set of red LED elements.

Figure 3:
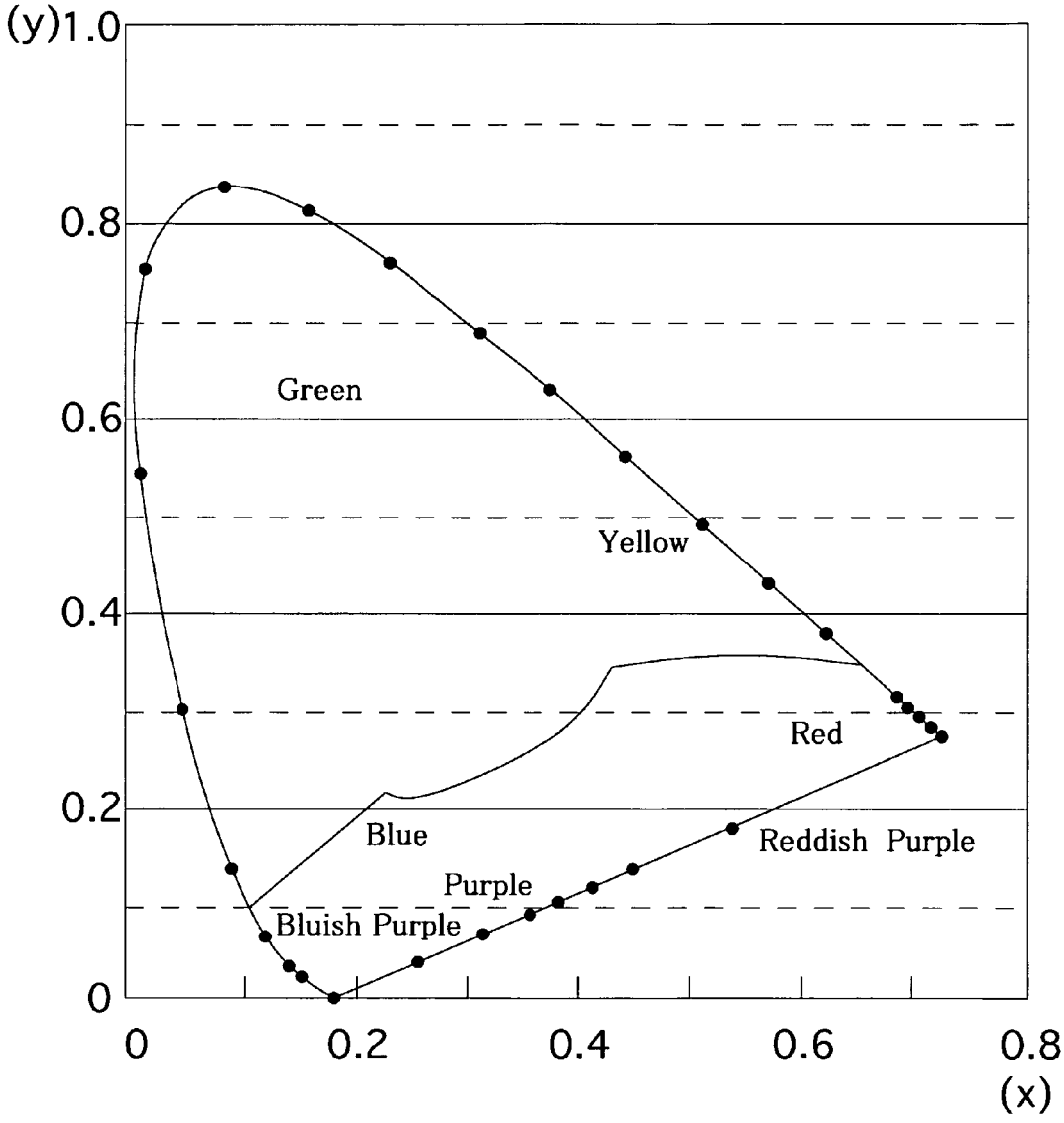
FIG. 3 is a xy chromaticity diagram of colored light in the red LED signal light to which the present invention is applied.

The emission color of the distinguishing LED elements is set to a purplish color, such as reddish purple, purple, or bluish purple as shown in FIG. 3, because the chromaticity of reddish purple, purple, and bluish purple are contained in a portion A of the chromaticity coordinates for colored light that contains xy coordinates of red as the signal light.

Within the xy coordinate range of the portion A in FIG. 3, reddish purple is the closest to red followed by purple and bluish purple. In this case, while the easiness of distinction is in the order of bluish purple, purple, and reddish purple by normal vision persons, all of these can be recognized as being distinct in chromaticity for color deficient persons from that of the other red LEDs, and the distinction is further enabled from a longer distance by intensifying a bluish tint.

Figure 4:
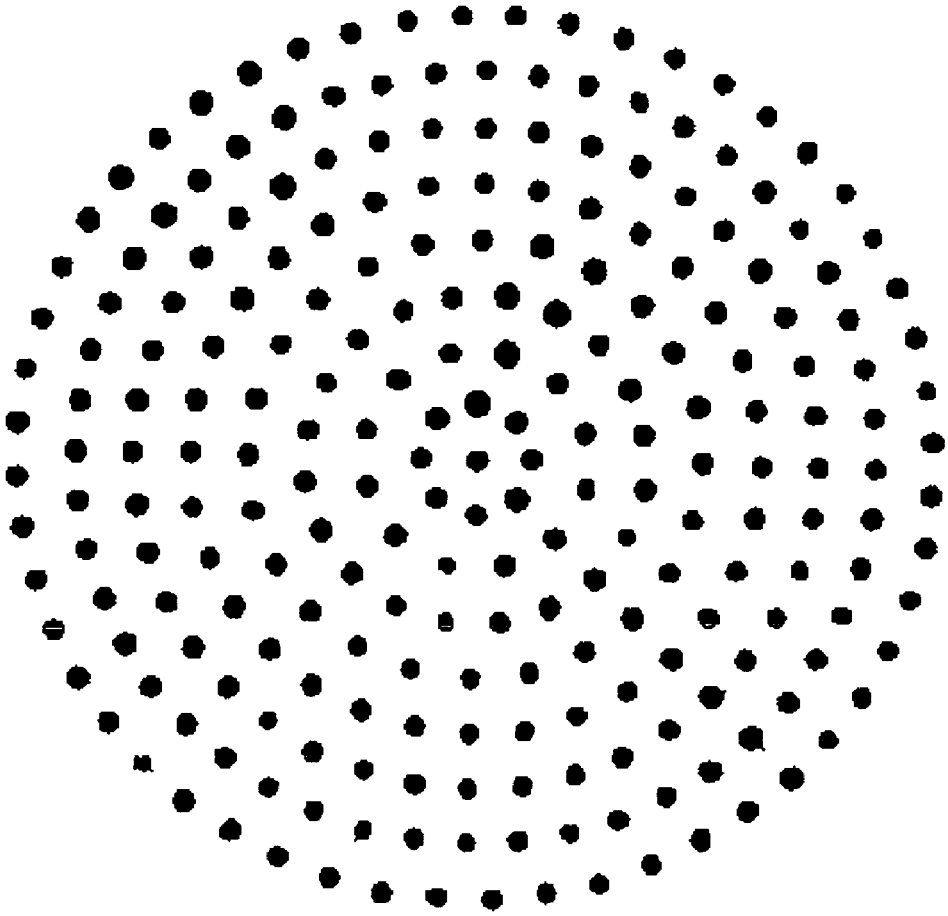
FIG. 4 is a photograph of a lighted state of the configuration of LED elements in the red LED signal light shown in FIG. 2 as viewed by a normal vision person.

A state of lighting by the configuration of LED elements in the red LED signal light shown in FIG. 2 as viewed by a normal vision person is shown in FIG. 4. In this case for normal vision persons, an LED signal light with the distinguishing LED elements can be provided in the manner that do not give an odd impression and indistinguishable from a certain distance. This is because these emitted distinguishing colors as purple, reddish purple, and bluish purple are a similar and associated color to surrounding red.

Figure 5:
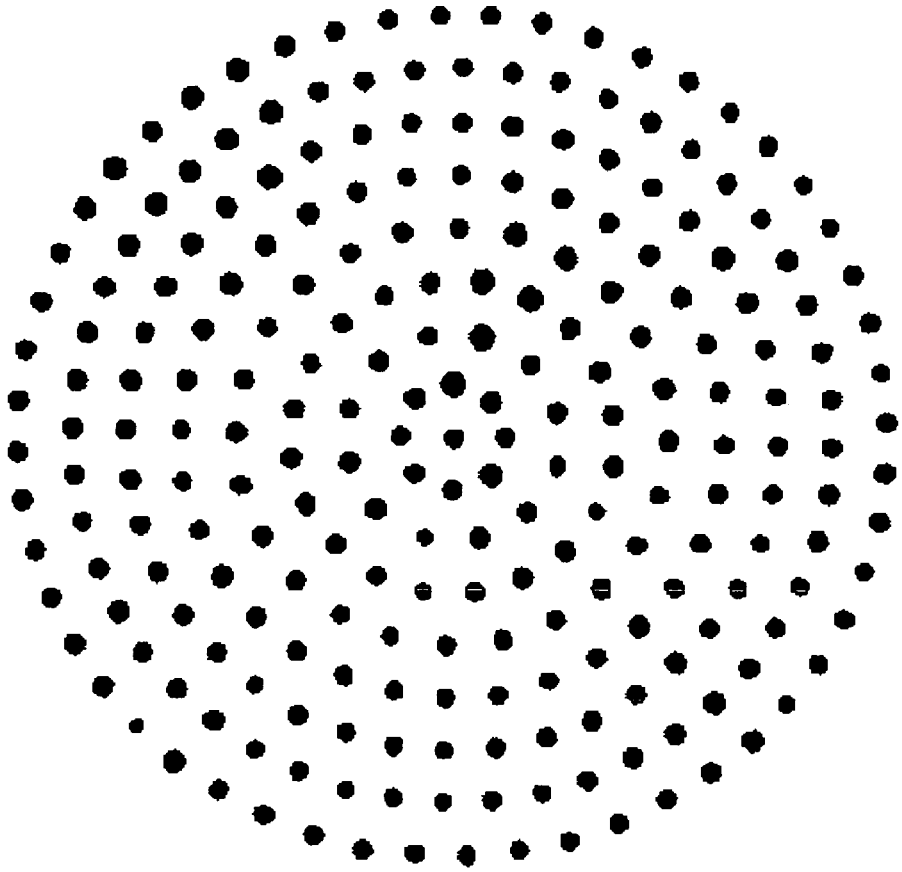
FIG. 5 is a photograph resulting from a computer simulation using authorized software for simulating the view of a color deficient person for the lighted state shown in FIG. 4.

A computer simulation of how the signal light is perceived by color deficient persons, based on the lighting state shown in FIG. 4, is shown in FIG. 5. In this case, the red color of the red LED elements disappears as being a dull brown, on the contrary the distinguishing LED elements of the purplish color turns out to appear a bright blue. Thus, the distinguishing LED elements configured in a pattern can be distinguished more clearly by the apparent hue difference.

Embodiment 2

Figure 6:
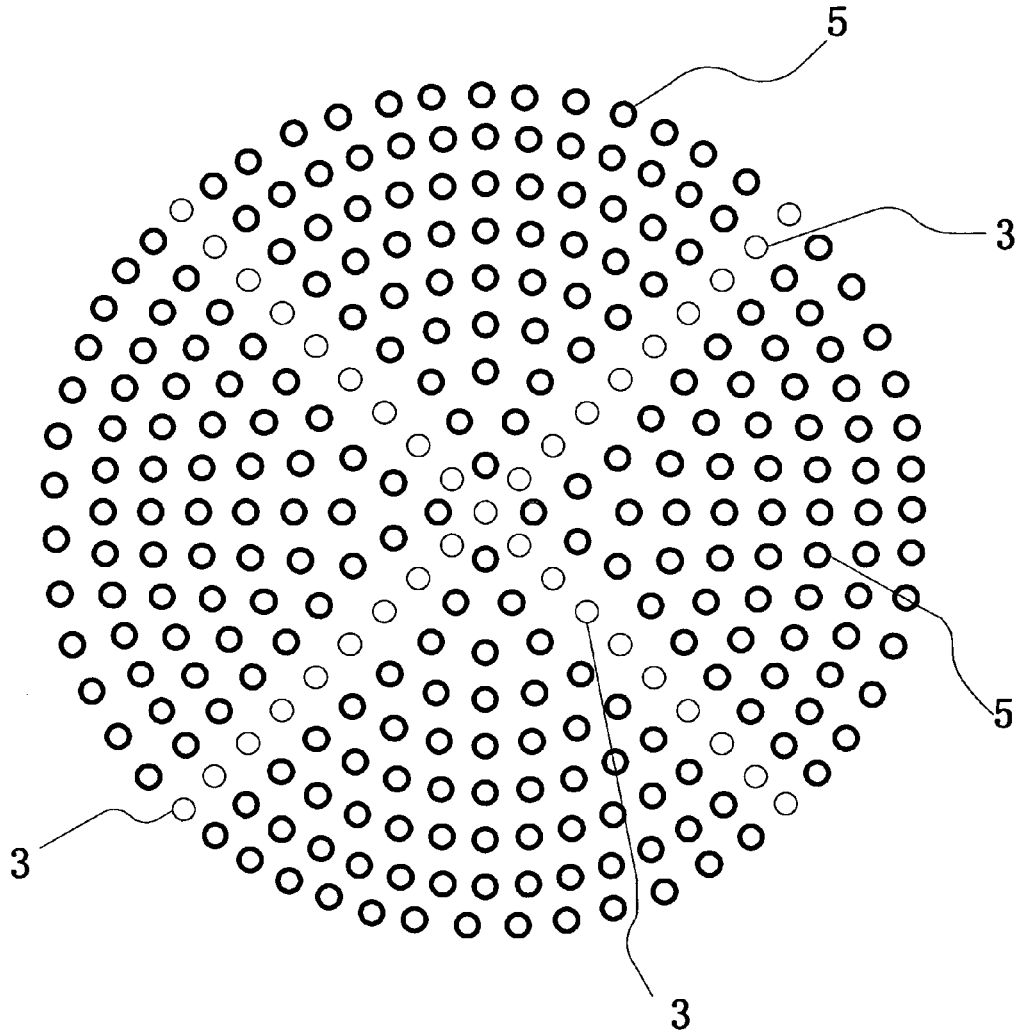
FIG. 6 is an explanatory view of a configuration of surrounding red LED elements in a red LED signal light according to Embodiment 2 to which the present invention is applied.

FIG. 6 shows a configuration of LED elements in a red LED signal light to which the present invention is applied.

Here, the red LED elements 3 are configured in a circular shape on the circular printed circuit board 2, and the distinguishing LED elements 5 are configured in an X-shape within the set of red LED elements 3.

The distinguishing LED elements 5 are the same kind of other red LED elements, and by the emission controller, the luminance of the LED elements configured in the X-shape is lowered to the performance level as much as approximately the 20% as the limit compared to the luminance of the other surrounding LED elements.

Color deficient persons can distinguish a sensitive luminance difference than normal vision persons, so that they can perceive the lighting of the LED elements configured in the X-shape as a brightness difference, while normal vision persons are hardly noticeable.

Embodiment 3

Figure 7:
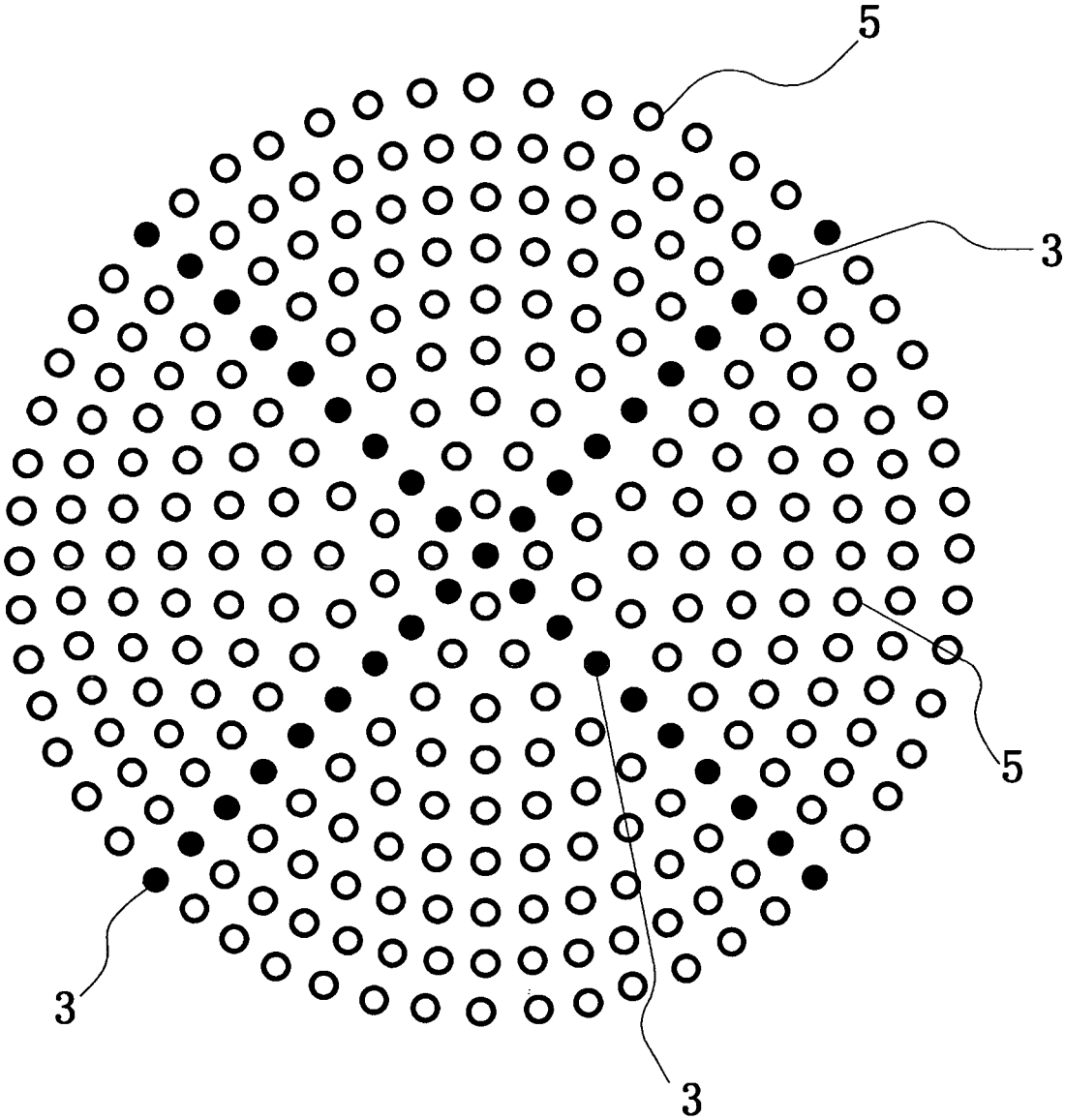
FIG. 7 is an explanatory view of a configuration of distinguishing LED elements in a red LED signal light according to Embodiment 2 to which the present invention is applied.

FIG. 7 shows a configuration of LED elements in a red LED signal light to which the present invention is applied.

Here, the red LED elements 3 are configured in a circular shape on the circular printed circuit board 2, and the distinguishing LED elements 5 are configured in an X-shape within the set of red LED elements 3.

The emission color of the distinguishing LED elements 5 is set to purple, reddish purple, bluish purple or other purplish color that is a similar color with respect to red, and by the emission controller, the luminance of the LED elements configured in the X-shape is lowered to the performance level as much as approximately the 20% as the limit compared to the luminance of the other surrounding LED elements.

The distinguishing LED elements 5 are thus effective by using full color LEDs of a varying chromaticity as reddish purple, purple, bluish purple, or other purple color that can be readily perceived by color deficient persons, and by utilizing the effective combination of "chromaticity difference" and "luminance difference" that appealed a significant statistical difference in perceptible distances between color deficient persons and normal vision persons.

An experiment was conducted in a time zone from 1:00 P.M. to 4:00 P.M., when direct sunlight will not hit the LED panel, to examine whether there is a significant difference in the color recognition by color deficient persons and normal vision persons from a position of 100 m rectilinear distance from a traffic light. The underlying methods were of recognizing luminance differences and of recognizing the various combinations of chromaticity and luminance differences for distinguishing LED elements configured in the X-shape.

For considering the presence or non-presence of astigmatism, a sample set consisting of 24 normal vision persons and seven color deficient persons (from weak to strong deutan deficiency) of ages from 21 to 82 and eyesight ranges from 0.5 to 2.0 was applied. Because it is known that protan deficiency is much fewer in number and recognizes red a much darker color than deutan deficiency, the contrast of the X-mark within a red LED signal light is more emphasized in the perception by protan. Accordingly, with the methods of the present experiment, protans exhibited higher numerical values than the data acquired from deutans. The present results using deutans thus exhibited numerical values on the safe side.

Tritans do not have problems in distinguishing signal lights.

Figure 8:
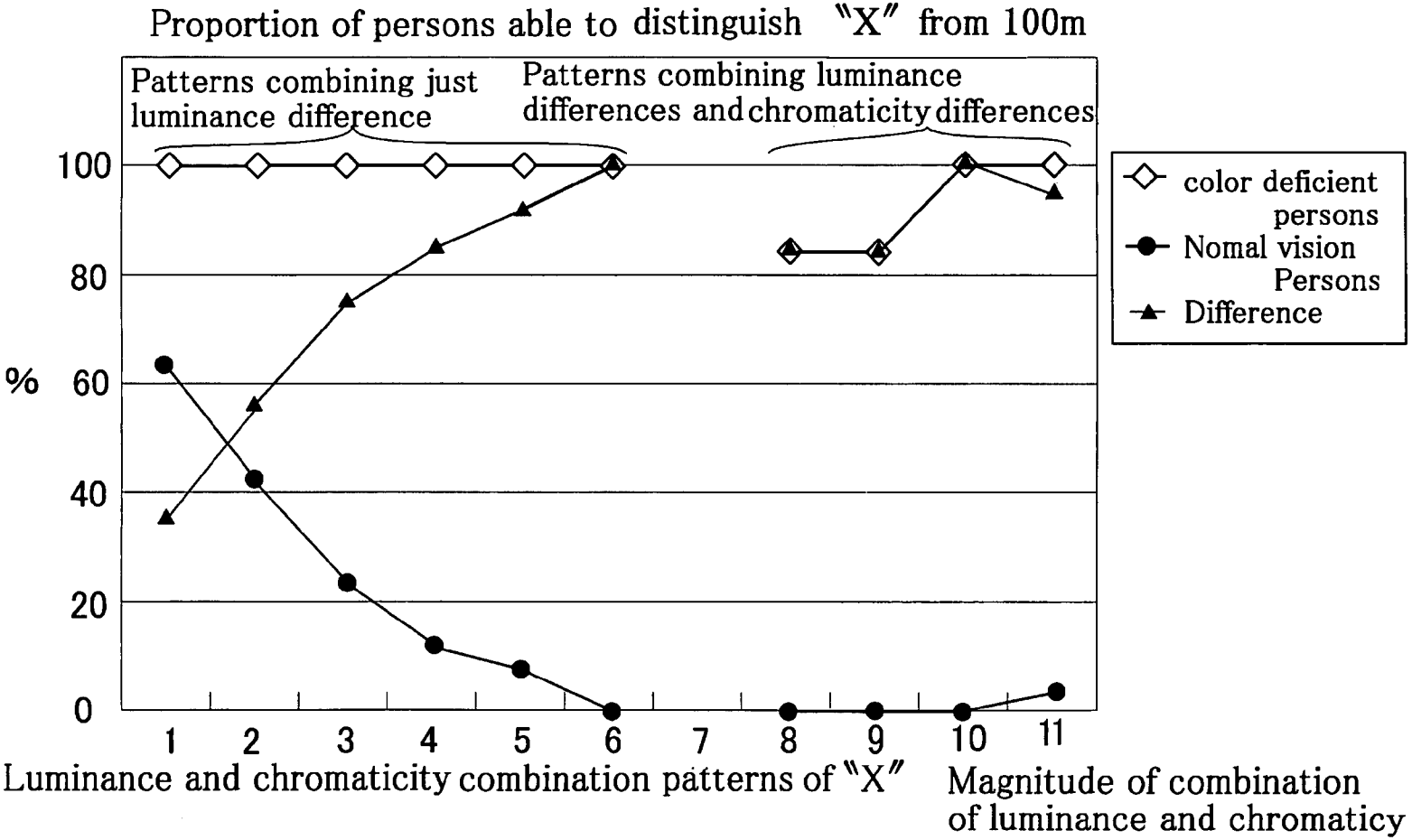
FIG. 8 is a graph comparing the level of recognition for distinguishing LED elements configured in an X-shape by color deficient persons and normal vision persons at a position of 100 m rectilinear distance from a traffic light.
Figure 9:
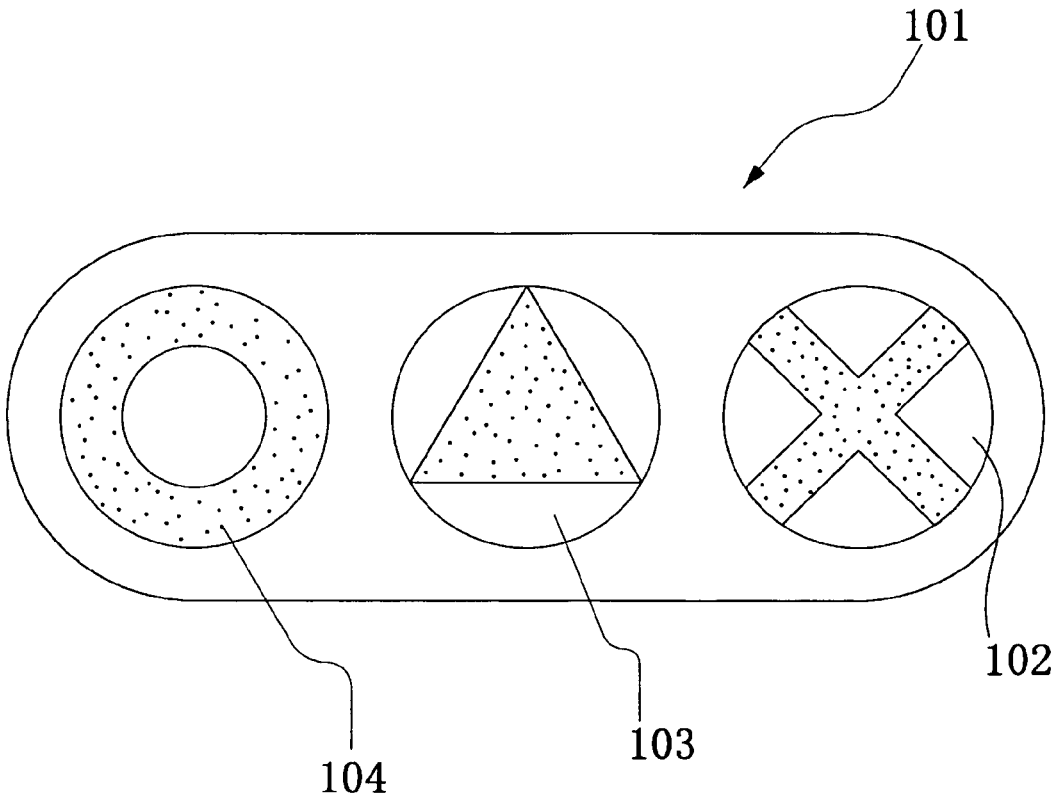
FIG. 9 is an explanatory diagram of an example of a conventional traffic signal light for color deficient persons.
Figure 10:
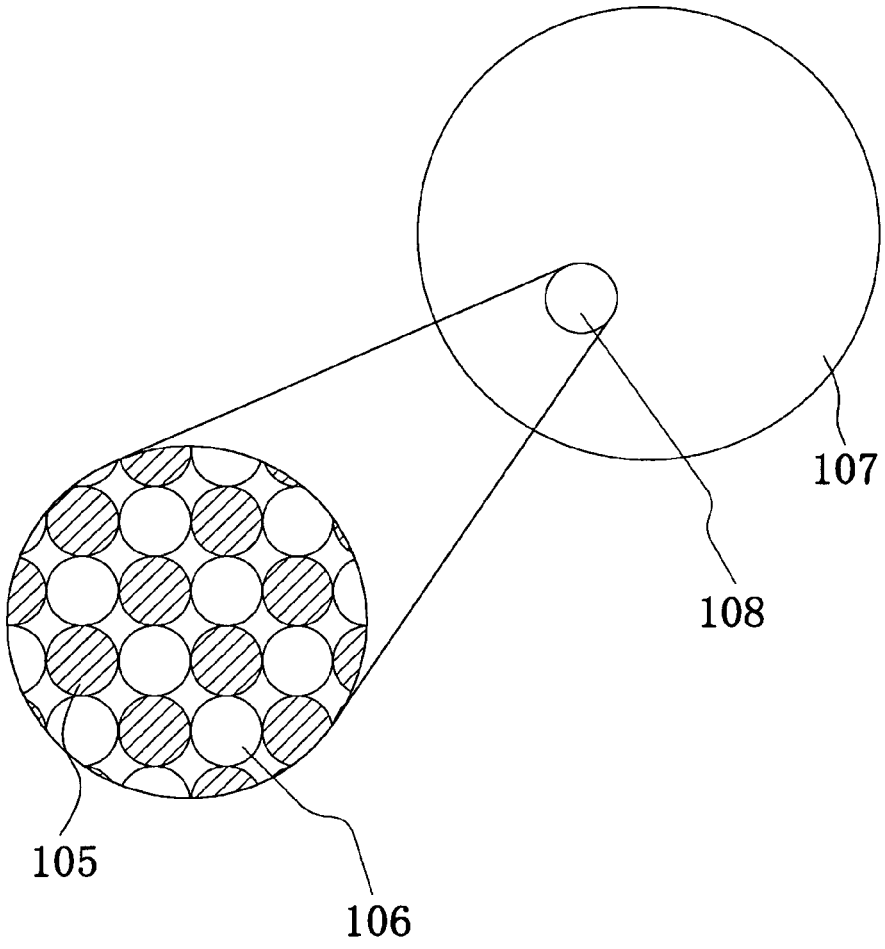
FIG. 10 is an explanatory diagram of another example of a conventional traffic signal light for color deficient persons.
Figure 11:
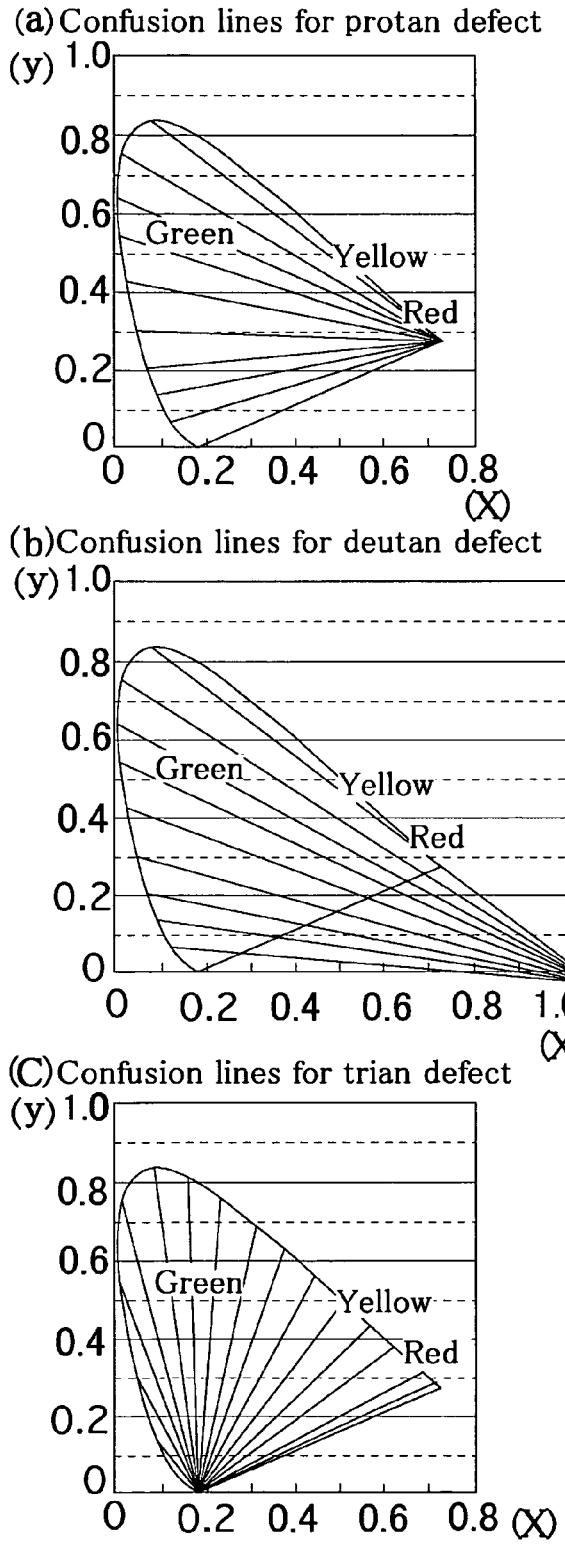
FIG. 11 shows the diagrams of isochromatic color confusion lines for protan, deutan, and tritan deficiency.
Figure 12:
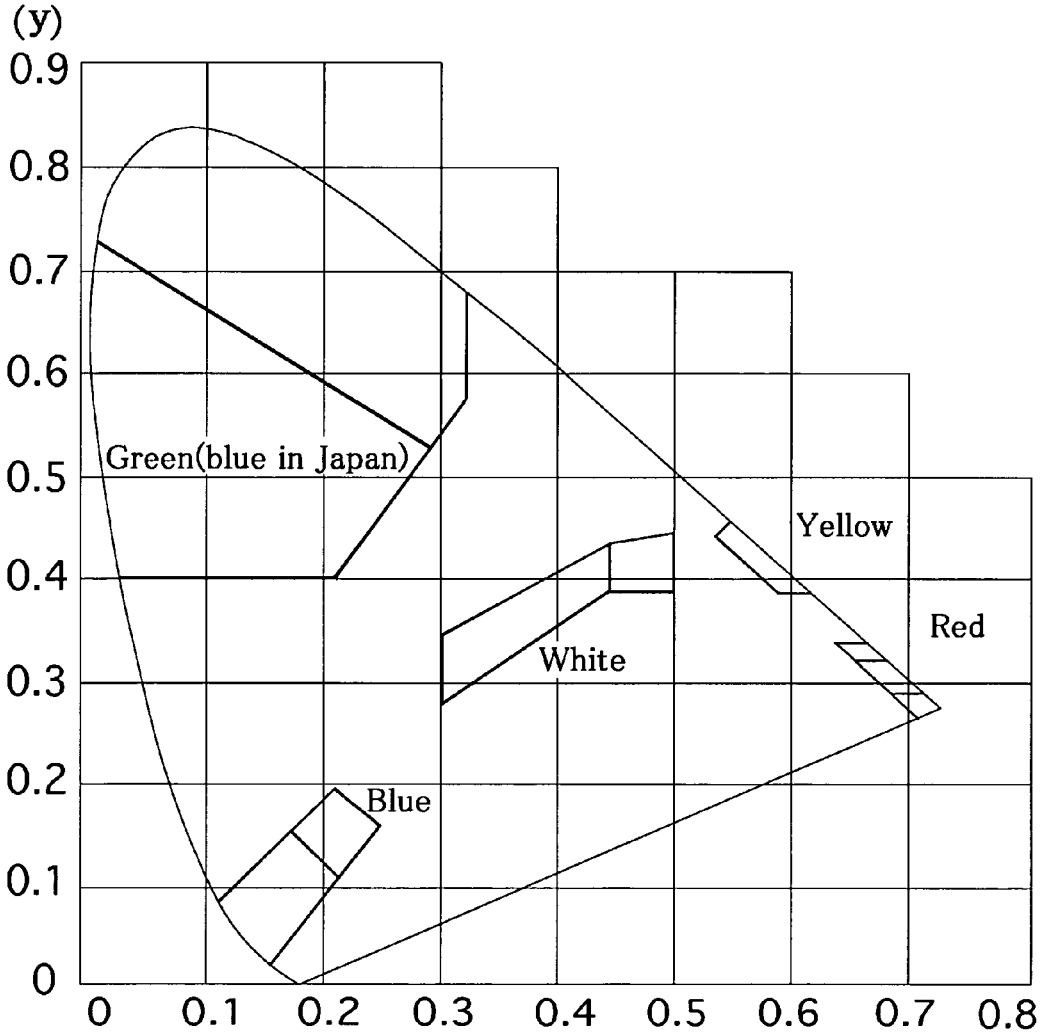
FIG. 12 is a diagram of standard chromaticity coordinates according to traffic regulations.

As can be seen from FIG. 8, which is a graph showing the proportion of persons that could see the X-mark from 100 m, color deficient persons exhibited a recognition rate of 100% while normal vision persons exhibited 24% in the examination conducted in six stages (patterns 1 through 6), where lightness difference in an X-mark was decreased stepwise from a conspicuous level. These examination results showed that color deficient persons were more sensitive to brightness difference than normal vision persons.

In the proceeding examination, using four stages of combination (patterns 8 through 11) as to differences in chromaticity and luminance, the recognition rate was 93% for color deficient persons and only 1% for normal vision persons. With this method of combining chromaticity and luminance differences, the luminance difference was adjusted to be lower than in the method employed only the luminance difference. The degree of compensation by color to luminance level was examined. It was found that as the blue tint color was increased, the recognizable distance increased gradually even when the luminance difference was lessened with normal vision persons.

With the method employing just the luminance difference, at the stage of pattern 6, that is, the luminance of the distinguishing LED elements configured in the X-shape being set to approximately ⅓ to ⅕ compared to the luminance of the surrounding LED elements, the recognition rate of color deficient persons was 100%, while the normal vision persons were unable to detect at all, exhibiting a recognition rate as 0% that achieved the underlying objective.

With the method combining chromaticity and luminance differences, at the stage of pattern 10, that is, the distinguishing LED elements were bluish purple in chromaticity and the luminance of the distinguishing LED elements was set to approximately ½ of the surrounding LED elements, the recognition rate of color deficient persons was 100%, while the normal vision persons were unable to detect at all exhibiting a recognition rate as 0%. The underlying objective was thus achieved.

The above results showed that the phenomenon existed with the method employed only a luminance difference, where all of the color deficient persons could distinguish the X-mark from the distance of 100 m, and none of the normal vision persons could. The distance is prescribed by the Commission Internationale de l clairage (CIE) as the requirement of the color recognition for signal light. The proportion of normal vision persons that could distinguish, however, tended to increase when the luminance difference level is wider than the pattern 6. Meanwhile, using the method of combining chromaticity and luminance differences, the phenomenon where only the party of normal vision persons could not distinguish was observed over a wider range of combinations due to the synergistic effect of chromaticity and luminance. The stability of the prospective effect can thus be expected in the implementation.

Although the configuration pattern of the distinguishing LED elements does not need to be the X-shape, and any pattern configuration enabling the lighting and flashing of the red signal light distinguishable from others may be employed. Because the X-shape universally expresses the meaning of O, it is preferable in that when it is displayed inside a red signal light, color deficient persons can instantly recognize it to mean: "stop."

Description of the Symbols

1 LED signal light
2 printed circuit board
3 red LED element
4 transparent lens cover
5 distinguishing LED element

What is claimed is:

1. An LED road traffic signal light, being a red LED signal light, comprising:

a set of red light emitting LED elements arranged as a red LED element set; and distinguishing LED elements embedded in the set of red light emitting LED elements so as to be distinguishable from a certain distance only by color deficient persons, the distinguishing LED elements comprising a reddish purple color in chromaticity as emitted light and being patterned generally in an X formation in the red LED element set so that said emitted light and X formation patterning of said distinguishing LED elements are visible only to color deficient persons and not detectable by non-color deficient persons.

2. An LED road traffic signal light, being a red LED signal light, comprising:

a set of red light emitting LED elements arranged as a red LED element Set; and distinguishing LED elements which are distinguishable from a certain distance only by color deficient persons and made of reddish purple in chromaticity as emitted light, said distinguishing LED elements being patterned generally in an X formation in the red LED element set, wherein a luminance of said distinguishing LED elements is adjusted lower than a luminance of the set of red LED elements surrounding said distinguishing LED elements.

* * * * *